US005186779A

United States Patent [19]

Tubbs

[11] Patent Number: 5,186,779

[45] Date of Patent: Feb. 16, 1993

[54] METHOD OF MAKING AN ELASTIC WAISTBAND WITH RELEASABLY SECURED DRAWSTRING

[75] Inventor: Robert W. Tubbs, Shelby, N.C.

[73] Assignee: Elastex, Inc., Asheboro, N.C.

[21] Appl. No.: 685,621

[22] Filed: Apr. 15, 1991

Related U.S. Application Data

[62] Division of Ser. No. 396,529, Aug. 21, 1989, Pat. No. 5,040,244.

[51] Int. Cl.[5] ..... A41D 27/00; B32B 31/00

[52] U.S. Cl. ..... 156/161; 156/160; 156/229; 156/217; 156/269; 156/324; 156/495

[58] Field of Search ..... 156/160, 163, 164, 229, 156/324, 494, 495, 583.5, 344, 161, 91, 93, 148, 176, 217, 250, 269; 2/220, 221, 236, 237

[56] References Cited

U.S. PATENT DOCUMENTS

| | | | |
|---|---|---|---|
| 887,610 | 5/1908 | Epstein et al. . | |
| 1,762,284 | 6/1930 | Thomas et al. . | |
| 2,854,670 | 10/1958 | Naccash . | |
| 2,994,091 | 8/1961 | Aftergood, Jr. . | |
| 3,118,803 | 1/1964 | Lynam | 156/463 X |
| 3,735,424 | 5/1973 | Maggio et al. | 2/237 X |
| 3,762,980 | 9/1973 | Maggio . | |
| 3,778,845 | 12/1973 | Miller . | |
| 3,783,074 | 1/1974 | Normanton | 156/164 X |
| 3,887,968 | 6/1975 | Lynam . | |
| 4,477,928 | 10/1984 | Graff . | |
| 4,596,616 | 6/1986 | Noda et al. . | |

FOREIGN PATENT DOCUMENTS

| | | | |
|---|---|---|---|
| 495408 | 5/1976 | Australia | 2/237 |

*Primary Examiner*—Jeff H. Aftergut
*Attorney, Agent, or Firm*—Bell, Seltzer, Park & Gibson

[57] ABSTRACT

A stretchable composite strip material comprising coextensive lengths of a band of elastic material and a stretchable non-elastic drawstring formed of textile material, and means releasably securing said drawstring alongside said band in lengthwise-bulked condition to medial portions of the elastic band is provided. The composite strip may be formed into a composite endless loop and incorporated into a garment. An apparatus and method for making the composite strip material is also provided.

12 Claims, 3 Drawing Sheets

M
W
S
10
20
15

M
W
32
20
15
S 30
10
30
15
32

20
11
40
41
20
15
11
30
46
20
43
42
47
35
20
37
39

39
12
43
12
40
42
T
35
45
37
39

39
40
41
43
20
15

42
45
43
42
20
15
45
20
40

37

METHOD OF MAKING AN ELASTIC WAISTBAND WITH RELEASABLY SECURED DRAWSTRING

This application is a divisional application of copending prior application Ser. No. 07/396,529, filed with the U.S. Patent Office on Aug. 21, 1989, now U.S. Pat. No. 5,040,244.

FIELD OF THE INVENTION

This invention relates to garments of the type having an elastic waistband and drawstring. More particularly this invention relates to an elastic waistband with a releasably secured drawstring which facilitates the insertion of the drawstring into the garment during the manufacture thereof.

BACKGROUND OF THE INVENTION

Sweatpants, swim trunks, athletic shorts and other garments often incorporate an elastic waistband and drawstring into the waistband portion of the garment. The elastic waistband allows one size waist to fit many different waists, whereas the drawstring may be utilized for grasping and pulling the waist portion tightly around the wearer.

Various methods of manufacturing a garment having an elastic waistband and a drawstring are known in the art. One common method wherein the waistband is sewn to a hemmed channel requires the insertion of the drawstring into the hemmed channel by using a hooked tool to feed the drawstring into the channel. Such a technique, however, is tedious and requires a time-consuming separate step of handling the drawstring.

An alternative method of manufacturing which eliminates this separate step of handling the drawstring is to simultaneously form the hemmed channel over the waistband and over the drawstring such as described for example in Naccash U.S. Pat. No. 2,854,670. This method, however, requires care to be taken so that the drawstring is not inadvertently stitched when the waistband is sewn to the hemmed channel. Additionally, garments produced by either of these methods are susceptible to the drawstring being displaced from the garment or becoming lodged within the hemmed channel of the garment.

Another previously suggested alternative is to form the drawstring as an integral part of the elastic material of the waistband such as described for example in Graff U.S. Pat. No. 4,477,928. Therein the drawstring is incorporated with the threads of the elastic material during the weaving or knitting process in making the elastic band. This, however, potentially weakens the waistband and increases the tendency of the waistband to roll longitudinally along the length of the drawstring.

Thus the existing methods of forming a garment having an elastic waistband and drawstring have undesirable features which the instance invention is able to overcome.

SUMMARY OF THE INVENTION

With the foregoing in mind, it is the primary object of this invention to provide a product, method and apparatus which facilitates the incorporation of an elastic band and a drawstring in the waistband of a garment during the manufacture thereof.

The present invention presents many advantages over prior art practices. Of primary significance is the ease of manufacturing the garment and the attendant reduction in manufacturing time provided by the present invention.

More particularly a further object of the present invention is to provide a stretchable composite strip material for use in manufacturing garments having drawstrings which comprises coextensive lengths of a band of elastic material, a stretchable non-elastic drawstring and means releasably securing the drawstring alongside the band in lengthwise-bulked condition to medial portions of the elastic band. The composite strip material is formed by releasably securing an indefinite length of the non-elastic drawstring lengthwise and in unstretched condition to the medial portion of an indefinite length of the elastic band while it is in a stretched condition.

The composite strip material may be formed into composite endless loops by severing a predetermined length of the composite strip material and connecting together opposite ends while in unstretched condition to form the composite endless loop. The composite endless loop may then be incorporated into a garment by stitchingly securing the endless loop to a folded-over waistband material so that the waistband material surrounds and envelops the loop by forming lines of stitching extending through the waistband material and through the elastic band. This is done while stretching portions of the elastic band and guiding the stretched portions so that the stitching extends alongside the drawstring without stitching the drawstring. Access to the composite endless loop may be gained by forming an opening in the folded-over material waistband material on the inside front portion of the garment. Portions of the now accessible drawstring may be grasped and pulled to effect rupturing of the releasable securement of the drawstring with the stitched elastic band.

BRIEF DESCRIPTION OF THE DRAWINGS

Some of the objects and advantages of the present invention having been stated, others will appear as the description proceeds, when considered in conjunction with the accompanying drawings, in which—

DETAILED DESCRIPTION OF THE INVENTION

Figure 1:
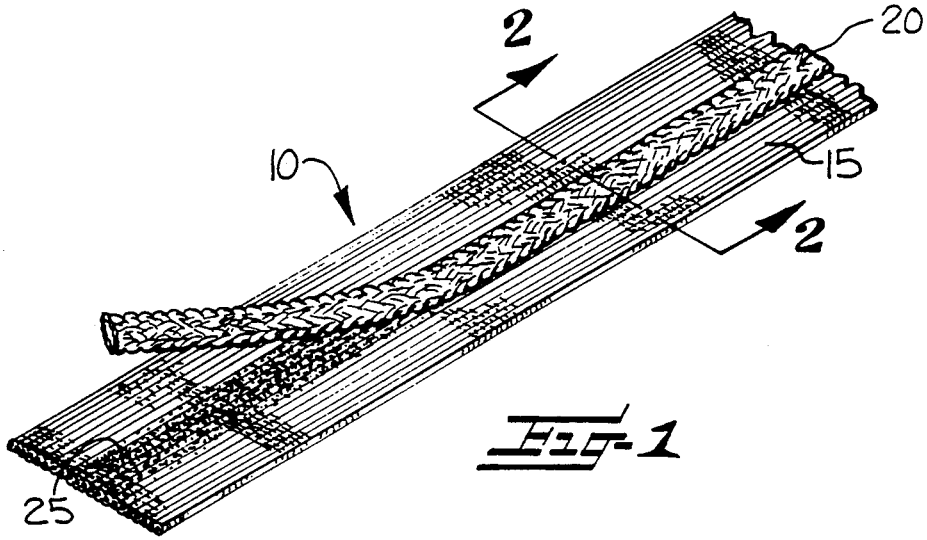
FIG. 1 is a top perspective view of a stretchable composite strip material in accordance with the present invention and illustrating the releasable securement of a drawstring to a band of elastic material.
Figure 2:
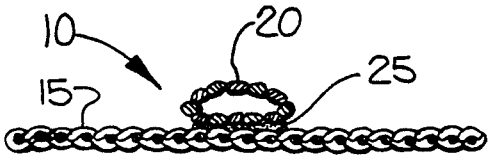
FIG. 2 is a cross-sectional view of the stretchable composite strip material taken along the line 2—2 of FIG. 1.
Figure 3:
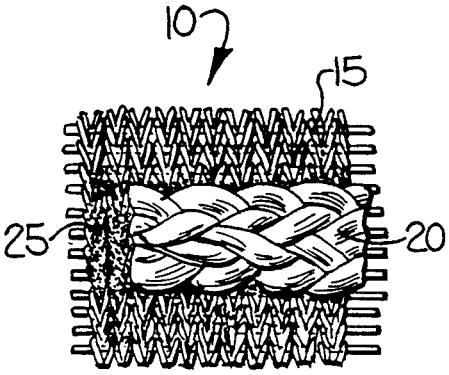
FIG. 3 is an enlarged fragmentary top plan view of the stretchable composite strip material.

A stretchable composite strip material 10 for use in the manufacture of garments of the type having an elastic waistband and a drawstring is shown in FIGS. 1-3. The composite strip material 10 generally comprises coextensive lengths of a band 15 of elastic material, a stretchable non-elastic drawstring 20 formed of textile material, and means 25 releasably securing the drawstring 20 in lengthwise-bulked condition alongside the band 15.

The elastic material of the band 15 preferably is a stretchable narrow fabric of knitted, woven or braided construction from natural and/or synthetic fibers. The band 15 typically is one to two inches in width for a standard garment, however, narrower or wider widths may be appropriate for particular styles and widths of garments. It is preferred that the elastic material may be stretchable to a length of at least about twice its relaxed length.

The drawstring 20 is preferably non-elastic and may also be of knitted, woven or braided fabric of natural and/or synthetic fibers. A preferred construction, as best seen in FIG. 2, is a tubular knit material formed of polyester fibers. The drawstring 20 typically is ⅛ to ½ inches in width and is about one-quarter the width of the elastic band 15. The drawstring 20 is stretchable longitudinally and is in lengthwise-bulked condition after it is releasably secured to the elastic band 15, with the elastic band 15 being in relaxed condition.

Figure 4:
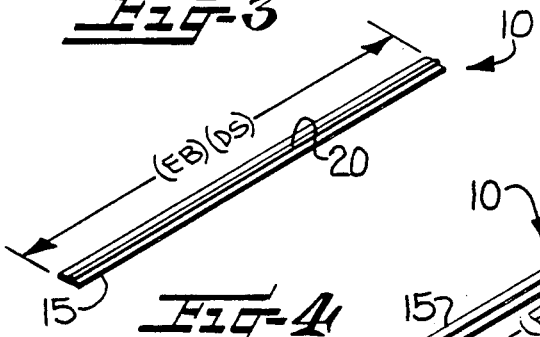
FIG. 4 is a perspective view illustrating the elastic band and bulked drawstring in relaxed condition.
Figure 5:
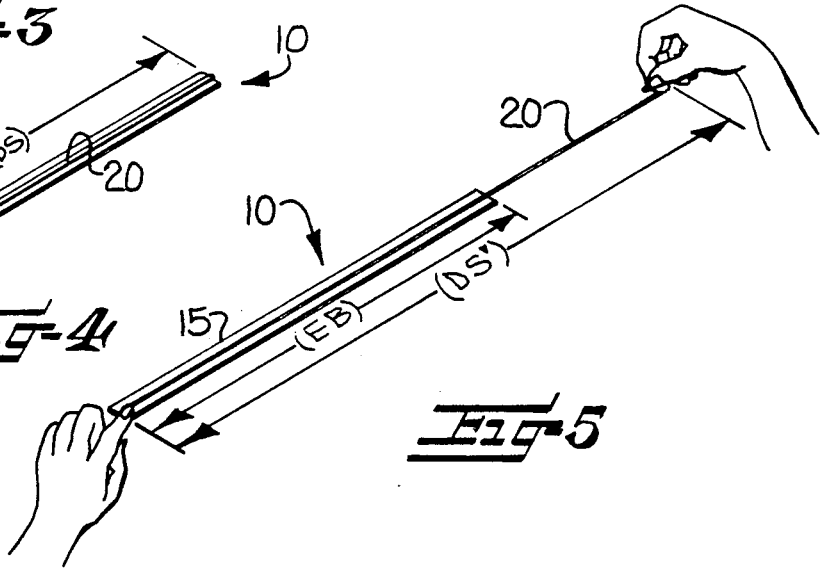
FIG. 5 is a perspective view illustrating the elastic band and unbulked drawstring in relaxed condition.

Referring to FIGS. 4 and 5, effective lengths of the drawstring 20 in bulked and unbulked condition are compared. The drawstring 20 is bulked as exhibited by an increase in width by releasably securing the drawstring 20 in unstretched condition to a medial portion of the elastic band 15 which is in a stretched condition. Thus as shown in FIG. 4 the elastic band 15 and drawstring 20 will have approximately the same effective lengths EB and DS when in relaxed condition. However, when the drawstring 20 is released from the elastic band 15 and unbulked the effective length DS', in relaxed condition, is greater than the effective lengths of the elastic band, EB and the bulked drawstring 20, DS. This substantial difference between DS and DS' enables wearers to have a length of drawstring 20 to grasp and pull about their waist.

The means 25 for releasably securing the drawstring 20 to the band 15 is a continuous or discontinuous line of a suitable adhesive. Preferably the adhesive is applied as a continuous line, is heat curable and may be cured at a relatively low temperature of 250° F. to 300° F. for about 10 to 20 seconds. Suitable heat curable adhesives are selected from the group consisting of vinyl acrylates, polyvinyl chloride, polyvinylidene chloride, styrene/butadiene and polyvinyl alcohol with ethylene vinyl acetate being preferred.

Figures 6, 7, 8, 9, 10, 11, 12:
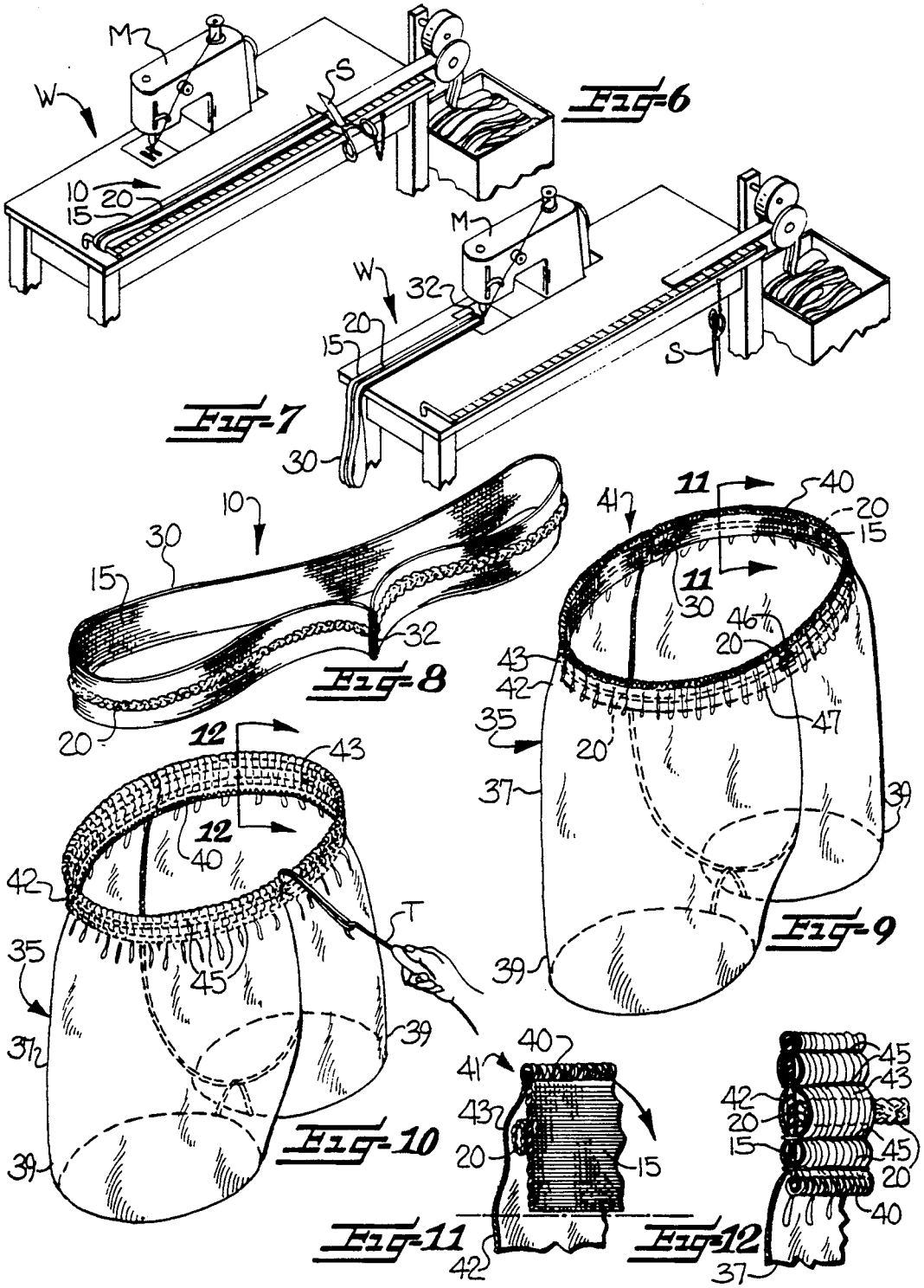
FIGS. 6 and 7 are perspective views of a work station illustrating the composite strip material being formed into composite endless loops.
FIG. 8 is a perspective view of the composite endless loop.
FIG. 9 is a perspective view of a garment incorporating the composite endless loop into the waist portion thereof before folding over a waistband material which surrounds and envelops the endless loop.
FIG. 10 is a perspective view of the garment after the waistband material has been folded-over so as to surround and envelop the composite endless loop.
FIG. 11 is a cross-sectional view taken along line 11—11 of FIG. 9 illustrating the composite endless loop before being surrounded and enveloped by the folded-over waistband material.
FIG. 12 is a cross-sectional view taken along line 12—12 of FIG. 10 illustrating the composite endless loop after being surrounded and enveloped by the folded-over waistband material.

Now referring to FIGS. 6-8, the stretchable composite strip material 10 may be formed into an endless loop 30 by connecting together opposite ends of a predetermined length of the composite strip material. In operation, a work station W is preferably provided wherein an operator selects a predetermined waist size to be formed, and then successively severs with scissors S or the like a corresponding, predetermined length of the composite strip material 10. The operator sews the opposite ends together using a sewing machine M. As shown in FIG. 8 this preferably is accomplished by placing the elastic band 15 and drawstring 20 in overlapping relation prior to being stitched and then using an over-edge stitch 32 to connect the elastic band and drawstring 15 together to form the endless loop 30.

The endless loop 30 may then be incorporated into a garment 35 such as the ones shown in FIGS. 9 and 10. An exemplary garment 35 may include a body portion 37 adapted to surround lower body portions of the wearer, leg portions 39 connected to and extending from the body portion 37, and a waistband portion 40 connected to upper portions 42 of the body portion 37 and adapted to surround the waist of the wearer.

The composite endless loop 30 is incorporated into the garment 35 by stitching 41 securing the endless loop 30 to a folded-over waistband material 43 of the waistband portion 40. The over-edge stitch 32 used to form the endless loop 30 is located in the back of the garment, and the stitching is started at this point. As shown in FIGS. 11 and 12 the folded-over waistband material 43 surrounds and envelops the endless loop 30 and is stitchingly secured to the endless loop 30 using multiple lines 45 of stitching extending through the waistband material 43 and through the elastic band 15. This is preferably accomplished by stretching portions of the elastic band 15 and guiding the stretched portions so that the lines 45 of stitching extend alongside the drawstring 20 without stitching it.

It is to be recognized that the composite strip material 10 could be incorporated into the garment 35 directly without forming a composite endless loop 30. In this embodiment, a hemming machine such as a Tunnell Elastic Hemmer is used to envelop and surround the composite strip material 10 with the waistband material 43. The machine automatically hems the waistband material 43 with the composite strip material 10 therein. The garment 35 is sewn together except for a back seam which allows the hemming machine to be used, and the garment 35 is then finished by closing the back and in effect forming a composite endless loop 30.

In either embodiment a drawstring access opening 46 may be formed in the folded-over waistband material 43 on the inside of a frontal portion 47 of the garment 35. The enveloped drawstring 20 is now accessible through the opening 46 and portions of the drawstring may be grasped and pulled such as by a hooked tool T through the opening 46 while effecting rupturing of the releasable securement of the drawstring 20 with the stitched elastic band 15.

Figure 13:
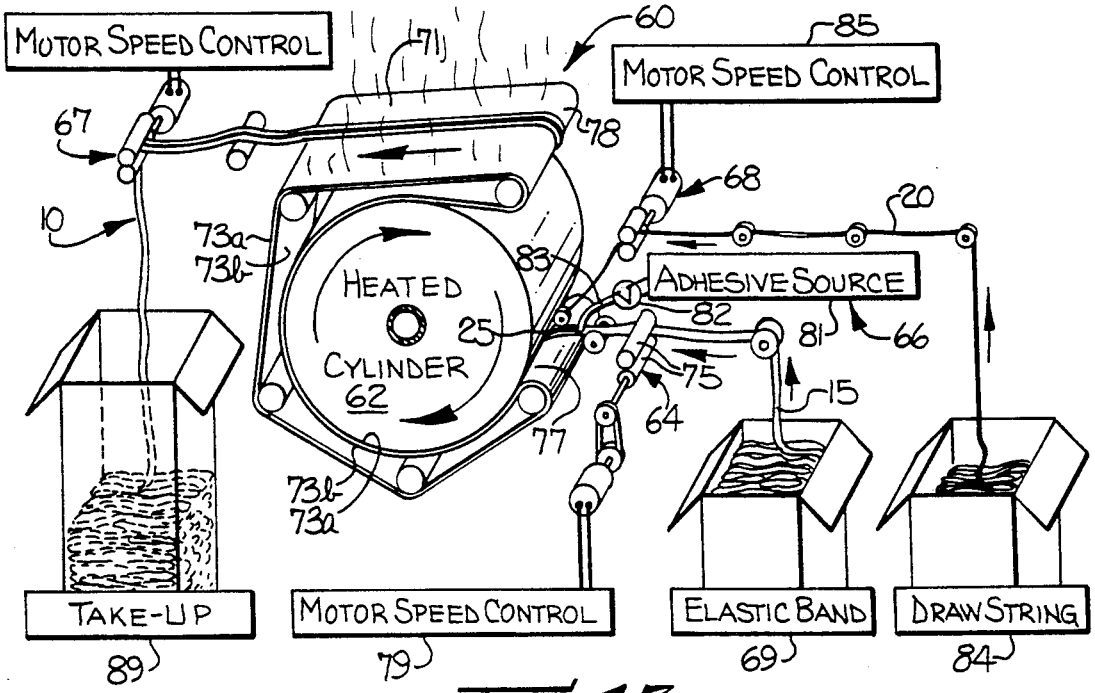
FIG. 13 is a diagrammatic and schematic view of the apparatus for releasably securing a drawstring to the elastic band.

Now referring to FIG. 13 an apparatus 60 for manufacturing the composite strip material 10 is shown. The apparatus 60 as will be described in more detail below generally includes a rotatable heated cylinder 62, means 64 for directing the elastic band 15 into heat transferable relationship with the heated cylinder 62, means 66 for depositing the releasable heat curable adhesive 25, means 68 for directing a stretchable drawstring 20 into engagement with the adhesive 25 and means 67 for directing the elastic band 15 with the drawstring 20 releasably secured thereto away from the heated cylinder 62.

In operation, the elastic band is directed from an elastic band source 69 such as a carton by the means 64 for directing the elastic band in a predetermined path of travel while in stretched condition and in heat transferring relationship around the periphery of the rotating heated cylinder 62. This is preferably accomplished by the means 64 for directing the elastic band comprising an endless apron 71 wherein the elastic band 15 is maintained in stretched condition using the nip between the heated cylinder 62 and the endless apron 71. The endless apron 71 preferably includes inner and outer runs 73*a*, 73*b*, respectively, arranged in close proximity to each other and controlled by a plurality of drive rolls 75. The inner and out runs 73*a*, 73*b* define a looped entrance end 77 and a looped exit end 78. The means 64 for directing the elastic band 15 also may include a motor speed control 79 operatively connected to the drive rolls 75 for controlling the movement of the elastic band 15.

The means 66 for depositing the releasable heat curable adhesive 25 deposits the adhesive on a medial lengthwise extending portion of the elastic band 25 from an adhesive source 81 through a metering valve 82 and a spray nozzle 83 such as shown or by using a roller apparatus. The adhesive 25 is applied prior to movement of the elastic band 15 into heat transfer relationship with the heated cylinder 62.

Simultaneously the means 68 for directing the stretchable drawstring 20 moves the drawstring 20 in a relaxed condition from a drawstring source 84 into engagement with the deposited adhesive 25 so as to move in unison with the stretched elastic band 15 in its path of travel around the heated cylinder 62. By maintaining the elastic band 15 in stretched condition and the drawstring 20 in unstretched condition, when the drawstring 20 is releasably secured to the elastic band 15, the drawstring 20 Will become bulked when the elastic band 15 is relaxed. The means 68 for directing the drawstring 20 may also include a motor speed control 85 for controlling the movement of the drawstring 20.

Figure 14:
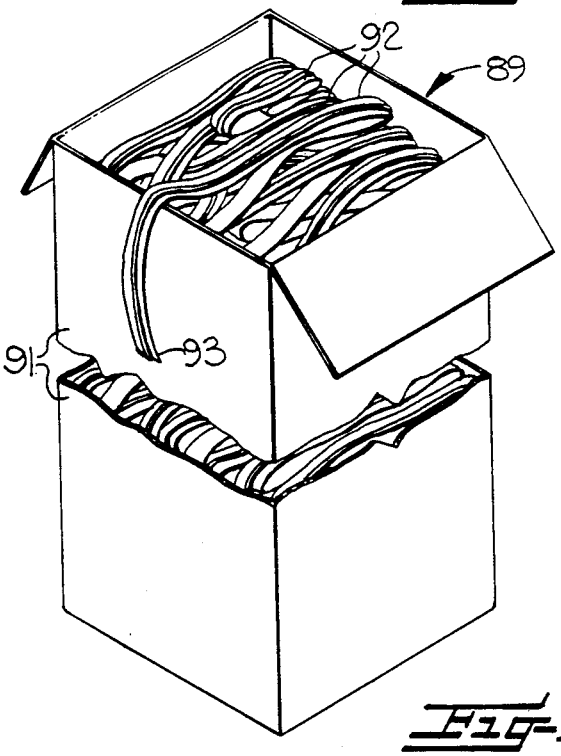
FIG. 14 is a perspective view of a package of the stretchable composite strip material.
Figure 15:
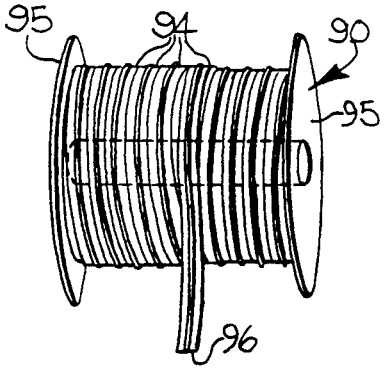
FIG. 15 is a perspective view of an alternative package of the stretchable composite strip material.

Means 67 for directing the elastic band 15 with the drawstring 20 releasably secured thereto and in lengthwise-bulked condition then directs the elastic band 15 and lengthwise-bulked drawstring 20 away from the heated cylinder 62 to a take-up rectangular carton 89 (FIG. 14) or a spool 90 (FIG. 15).

Using a rectangular carton 89, layers of the composite strip material 10 are positioned in the carton 91 with each layer comprising folds 92 of the composite strip material 10 arranged in overlapping relationship with a free end 93 of the strip material 10 being readily accessible in the upper most layer in the carton 89. An alternative package shown in FIG. 15 comprises a flange spool 90 and layers of the composite strip material arranged in convoluted windings 94 on the spool 90 with the flanges 95 of the spool 90 guidingly engaging opposite ends of the wound composite strip material 10. A free end 96 of the composite strip material 10 may be readily accessible on the outer-most winding 94.

In the drawings and specifications there has been disclosed preferred embodiments of the invention and although specific terms are employed, they are used in a generic and descriptive sense only and not for the purpose of limitation, the scope of the invention being set forth in the following claims.

That which is claimed is:

1. A method of releasably securing a drawstring to a band of elastic material for use in garments having an elastic waistband and a drawstring, said method comprising directing an elastic band in a predetermined path of travel in a stretched condition and in a heat transferring relationship around a periphery of a rotating heated cylinder, simultaneously depositing a releasable heat curable adhesive to a medial lengthwise extending portion of the elastic band prior to movement of the elastic band into heat transfer relationship with the heated cylinder, directing a non-elastic stretchable drawstring in a relaxed condition into engagement with the deposited adhesive so as to be carried by the elastic band in a path of travel around the rotating cylinder, curing the deposited heat curable adhesive as it is carried by the elastic band around the heated cylinder and directing the elastic band with the drawstring releasably secured thereto away from the heated cylinder, said drawstring, upon relaxation of the elastic band, being in a lengthwise-bulked condition.

2. A method according to claim 1 wherein the curing of the deposited heat curable adhesive as the elastic band is directed around the rotating heated cylinder along the path occurs at a temperature of from about 250° F. to 300° F. for 10 to 20 seconds.

3. A method according to claim 1 wherein simultaneously depositing a releasable heat curable adhesive comprises applying a line of adhesive to the medial lengthwise extending portion of the elastic band.

4. A method according to claim 1 wherein the elastic band material is stretchable to a length of at least about twice its relaxed length.

5. A method according to claim 1 wherein the non-elastic stretchable drawstring is a knitted fabric of natural fibers, synthetic fibers, or combinations of natural and synthetic fibers.

6. A method according to claim 1 wherein the heat curable adhesive is selected from the group consisting of vinyl acrylates, polyvinyl chloride, polyvinylidene chloride, styrene/butadiene and polyvinyl alcohol.

7. A method according to claim 1 further comprising the additional steps of severing a predetermined length of the elastic band with the drawstring releasably secured thereto and in lengthwise-bulked condition and connecting together opposite ends of the severed elastic band with the drawstring releasably secured thereto to form an endless loop.

8. A method of releasably securing a drawstring to a band of elastic material to form a combination and incorporating the combination into a waistband of a garment, said method comprising directing an elastic band in a predetermined path of travel in a stretched condition and in a heat transferring relationship around a periphery of a rotating heated cylinder, simultaneously depositing a releasable heat curable adhesive to a medial lengthwise extending portion of the elastic band prior to movement of the elastic band into heat transfer relationship with the heated cylinder, directing a non-elastic stretchable drawstring in a relaxed condition into engagement with the deposited adhesive so as to be carried by the elastic band in a path of travel around the rotating cylinder, curing the deposited heat curable adhesive as it is carried by the elastic band around the heated cylinder, directing the elastic band with the drawstring releasably secured thereto away from the heated cylinder, said drawstring, upon relaxation of the elastic band, being in a lengthwise-bulked condition, severing a predetermined length of the elastic band with the drawstring releasably secured thereto in a lengthwise-bulked condition, connecting together opposite ends of the severed elastic band with the drawstring releasably secured thereto to form an endless loop, and incorporating the endless loop into the waistband of a garment.

9. A method according to claim 8 wherein the garment contains a drawstring access opening through which portions of the drawstring may be grasped and pulled.

10. A method according to claim 8 wherein the elastic band material is stretchable to a length of at least about twice its relaxed length.

11. A method according to claim 8 wherein the non-elastic stretchable drawstring is a knitted fabric of natural fibers, synthetic fibers, or combinations of natural and synthetic fibers.

12. A method according to claim 8 wherein the heat curable adhesive is selected from the group consisting of vinyl acrylates, polyvinyl chloride, polyvinylidene chloride, styrene/butadiene and polyvinyl alcohol.

* * * * *